United States Patent [19]

Gilmour

[11] 4,070,779

[45] Jan. 31, 1978

[54] DISPLAY SIGN

[75] Inventor: Ralph M. Gilmour, Montreal, Canada

[73] Assignee: Claude Neon Industries Limited, Toronto, Canada

[21] Appl. No.: 718,667

[22] Filed: Aug. 30, 1976

[30] Foreign Application Priority Data

Sept. 2, 1975 Canada ..... 234746

[51] Int. Cl.[2] ..... G09F 13/04

[52] U.S. Cl. ..... 40/575; 40/573; 40/578

[58] Field of Search ..... 40/132 R, 132 A, 133 R, 40/132 D, 125 H, 125 G, 130 R, 152.2; 24/DIG. 18, 204

[56] References Cited

U.S. PATENT DOCUMENTS

| | | | |
|---|---|---|---|
| 1,400,296 | 12/1921 | Kusel | 40/132 R |
| 2,029,221 | 1/1936 | Burgess et al. | 40/132 R |
| 2,513,576 | 4/1950 | Luray | 40/132 R |
| 2,588,545 | 3/1952 | Lawrence | 40/130 R |
| 3,068,599 | 12/1962 | Myerson | 40/132 R |
| 3,571,999 | 7/1969 | Downing | 52/483 |
| 3,824,726 | 7/1974 | Schubert | 40/132 R |
| 3,863,372 | 2/1975 | Stilling | 40/132 R |
| 3,934,365 | 1/1976 | Stein et al. | 40/125 G |

*Primary Examiner*—Samuel W. Engle
*Assistant Examiner*—Ralph Palo
*Attorney, Agent, or Firm*—Rogers, Bereskin & Parr

[57] ABSTRACT

A display sign is disclosed for displaying printed matter on a backlighted poster or the like. The sign includes a display case defining a first compartment containing a light source, the display case having a front opening for the transmission of light therethrough. A closure panel is adapted to cover the front opening, the closure panel having a central transparent face panel. A concave translucent diffuser panel is located between the face panel and the light source so that the curvature of the concave diffuser panel extends toward the light source to define a second compartment between the diffuser panel and the face panel. VELCRO fastening means locate and retain the poster in the second compartment spaced between the closure panel and the concave diffuser panel. Vent openings communicate with the second compartment for the circulation of air around the poster. The concave diffuser panel and the vent openings help to prevent the accumulation of condensation in the second compartment and consequent moisture damage to the poster.

13 Claims, 2 Drawing Figures

DISPLAY SIGN

This invention relates to display signs of the type having a light source for backlighting a poster containing printed matter or the like.

Display signs have been made in the past having a rectangular case or enclosure with an opening on one side thereof and a light source inside the enclosure. A transparent face panel covers the opening and a poster or printed copy is located inside the display sign adjacent to the transparent face panel so that it is readable when illuminated from behind by the light source. In order to eliminate shadows, a translucent diffuser panel has been located adjacent to the poster between the poster and the light source.

A disadvantage of the prior art signs of this arrangement is that when external sources of heat, such as the sun, strike the sign, the air inside the enclosure is heated to a relatively high temperature. When the air cools, moisture condenses on the transparent and translucent panels wetting the poster. This causes water marks and wrinkles in the poster, which are undesirable. To overcome this problem, the posters could be printed on plastic sheets, but signs printed on plastic are expensive and difficult to produce. The transparent and translucent panels could also be spaced widely apart, so that they do not contact the poster. However, this wide spacing reduces the definition or sharpness of the display and the display sign becomes undesirably wide.

The present invention provides a concave translucent diffuser panel located in the sign so that the curvature of the diffuser panel extends away from the poster and toward the light source. This curvature ensures that the diffuser panel does not normally come into contact with the poster, so that moisture tending to condense on the face and diffuser panels cannot accumulate and mark or wrinkle the poster.

According to the invention, a display sign is provided for displaying printed matter on a poster or the like. The display sign has a display case defining a first compartment containing a light source, the display case having a front opening for the transmission of light therethrough. The display case also has a closure panel adapted to cover the front opening, the closure panel having a central transparent face panel. A concave translucent diffuser panel is located between the face panel and the light source, the curvature of the concave diffuser panel extending toward the light source to define a second compartment between the diffuser panel and the face panel. Also, releasable fastening means are provided for locating the poster in the second compartment spaced between the face panel and the concave diffuser panel, so that the poster is viewed through the transparent face panel and may be backlighted by the light source.

A preferred embodiment of the invention will now be described, by way of example, with reference to the accompanying drawings, in which.

Figure 2:
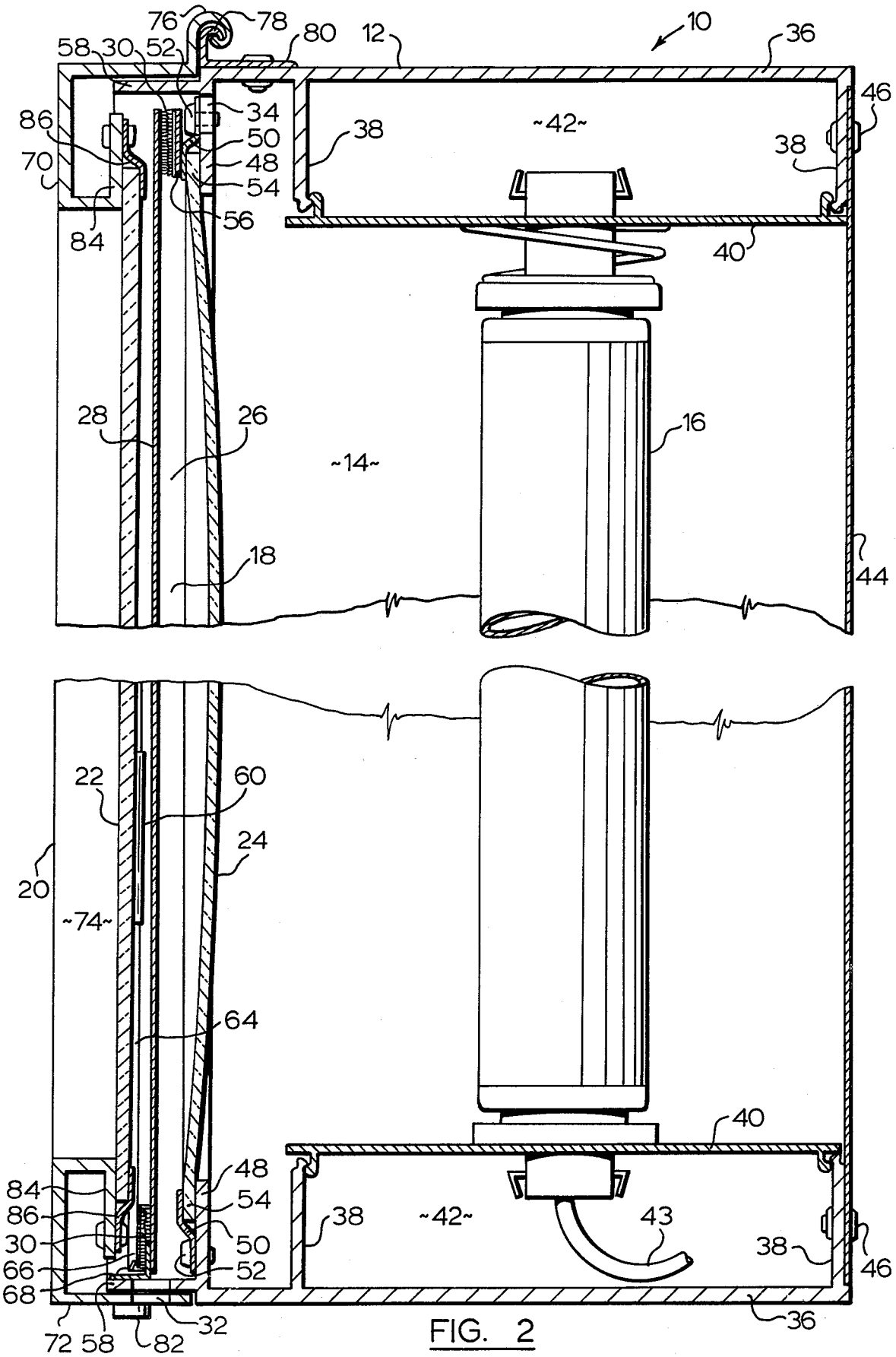
FIG. 2 is a sectional view taken along line 2-2 of FIG. 1.

Referring to the drawings, a preferred embodiment of a display sign according to the present invention is generally indicated by reference numeral 10. Display sign 10 includes a display case 12 which defines a first compartment 14 containing a light source 16. Display case 12 has a front opening 18 which is covered by a closure panel 20 having a central transparent face panel 22. A concave translucent diffuser panel 24 is located between face panel 22 and light source 16. The curvature of diffuser panel 24 extends toward light source 16 to define a second compartment 26 (FIG. 2) between face panel 22 and diffuser panel 24. A translucent poster 28 containing printed matter to be displayed is located in second compartment 26 spaced between face panel 22 and diffuser panel 24. Poster 28 is held in position by fasteners 30 which are formed of two cohesive fabrics which adhere when pressed together. One type of such fasteners is marketed under the trade mark VELCRO. When display sign 10 is assembled, a person views poster 28 by looking from the front through face panel 22. If light source 16 is illuminated, poster 28 would then also be backlighted when viewed through face panel 22.

Display case 12 is also formed with lower vent openings 32 communicating with second compartment 26. Upper vent openings 34 communicate with both first and second compartments 14, 26 to permit the passage of air between these two compartments. The purpose of vent openings 32, 34 is to help remove moisture condensing inside second compartment 26, as will be described more fully below.

Turning now to a more detailed description of display sign 10, display case 12 has a main or rear box-like portion formed of horizontal and vertical sides 36 which are made from lengths of extruded aluminum section. Sides 36 have inwardly extending parallel flanges 38, which together with cover members 40 form wiring raceways 42 to accomodate the electrical connections and wiring 43 required for light source 16. A back panel 44 is fastened to rear flanges 38 by rivets 46 to close the back of display case 12.

Sides 36 also have front inwardly extending flanges 48 which support concave diffuser panel 24. Diffuser panel 24 is held in position by elongated retaining strips 50 which are fastened to front flanges 48 by screws 52. Diffuser panel 24 is formed of one-eighth inch thick white acrylic material and is concave in the direction of both the horizontal and vertical axes of the panel, so that it has a maximum deflection or displacement at the centre of approximately three-quarters of an inch. A one half inch planar border edge 54 is formed on diffuser panel 24 to provide a gripping surface for retaining strips 50. Rectangular metal tabs 56 are spot welded to each end of the upper retaining strip 50, and a rectangular piece of VELCRO fastener is attached to each metal tab 56 by a heat resistant adhesive to form part of fastener 30. A mating piece of VELCRO fastener is also adhesively attached to the upper corners of poster 28 on the rear side of poster 28 to form the other or mating part of upper fasteners 30.

As discussed above, the VELCRO type fastener comprises two cohesive fabrics which adhere when pressed together. One of these fabrics has a plurality of tiny plastic hooks and the other fabric has a plurality of tiny plastic loops. The hooks releasably engage the loops when the fabrics are pressed together. In display sign 10, the fabric with the loops is attached to the poster and the fabric with the hooks is attached to display case 10. The reason for this is that the hook pieces have a longer life than the loop pieces, and since the life of a poster 28 is usually shorter than that of display sign 10, the VELCRO fasteners in display sign 10 require replacement less frequently than if the loop fabrics were attached to the display sign.

The sides 36 of display case 12 also have forward projecting flanges 58. Guide brackets 60 are mounted on the inwardly facing surfaces of the vertical forward projecting flanges 58 by rivets 62. Rectangular rods 64 are slidably retained by guide brackets 60, so that rods 64 can slide vertically for installation of poster 28 as will be described below. Metal tabs 66 are attached to the lower ends of rods 64 and pieces of VELCRO fastener are adhesively attached to the rearwardly facing surfaces of metal tab 66 to form part of the lower fasteners 30. Corresponding pieces of mating VELCRO fastener are adhesively attached to the lower frontwardly facing surfaces of poster 28 to complete the lower fasteners 30. As in the case of upper fasteners 30, the loop piece of VELCRO fabric is attached to poster 28 and the hook piece of VELCRO fabric is attached to metal tab 66 to maximize the life of the fasteners. A centrally located retainer angle 68 is rivetted to the lower horizontal forward projecting flange 58 to hold the poster 28 away from face panel 22.

Closure panel 20 includes respective upper and lower horizontal extruded members, 70, 72 and vertical side extruded members 74. Upper extruded member 70 is formed with a top curled section 76 which engages an inner curled section 78 formed on a horizontal length of angle stock rivetted to the top of side 36 of display case 12. Curled sections 76, 78 form a hinge allowing closure panel 20 to pivot or swing upwardly to provide access to poster 28 located in second compartment 26. Curled sections 76, 78 also make this hinge generally watertight, preventing water from entering second compartment 26 from above sign 10.

Lower extruded member 72 is attached to the lower forward projecting flange 58 by screws 82 when display sign 10 is assembled. Extruded members 70, 72 and 74 also have outwardly extending flanges 84 to which elongated retaining strips 86 are rivetted to hold face panel 22 in position.

Lower vent openings 32 pass through lower extruded member 72 and the lower forward projecting flange 58 to permit air to flow into and out of second compartment 26. In display sign 10, there are 5 lower vent openings 32 horizontally spaced apart, which correspond with 5 upper vent openings 34 formed in the upper front flange 48. Lower vent openings 32 also act as drainage holes if water should enter second compartment 26. This water may enter second compartment 26 between extruded members 72, 74 and face panel 22, when water comes into contact with the outer surface of face panel 22. Water may contact face panel 22, for example, during a rain storm or during the washing of panel 22. This water drains out of display sign 10 through openings 34 before it has a chance to accumulate and damage poster 28.

To remove or replace a poster inside display sign 10, screws 82 are removed and closure panel 22 is pivotted outwardly and upwardly to provide access to poster 28. If a poster is already in place, VELCRO fasteners 30 are separated and the poster is removed from display sign 10. To insert a new poster, the poster is grasped at the top, stretched horizontally and upper fasteners 30 are pressed together to hold the top of the poster in position. Vertical rods 64 are than slid upwardly, the poster is tucked behind rods 64, the bottom of the poster is stretched horizontally and the lower mating portions of VELCRO fasteners 30 are pressed together. Rods 64 are then allowed to move downwardly so that the weight of the rods stretches the poster vertically. Poster 28 is then tucked behind retaining angle 68 and closure panel 20 is once again pivotted downwardly and fastened in the closed position by screws 82. If desired, panel 22, 24 could be sprayed with an anti-static spray before closure panel 20 is closed, to avoid any problems caused by static electricity.

When light source 16 is illuminated, heat is generated causing the air inside first compartment 14 to expand.

This expanding air passes from first compartment 14 into second compartment 26 causing air to flow past poster 28 and out through lower vent openings 32. If an external source of heat strikes display sign 10, such as the sun when sign 10 is located outdoors, the air inside second compartment 26 may get hotter than the air inside first compartment 14. This may cause additional air flow past poster 28 and out through lower vent openings 32. If the air inside first compartment 14 is being cooled, air would flow in through lower vent openings 32, past and around poster 28 and through upper vent openings 34 into first compartment 14. It will be apparent therefore, that the heating and cooling taking place in first and second compartments 14, 26 causes air to circulate around and past poster 28. This air circulation removes excess moisture from poster 28 to help prevent the poster from becoming limp and wrinkled inside display sign 10.

When display sign 10 is cooled, such as at night when the sign is located outdoors, condensation has a tendency to form on the surfaces of face panel 22 and diffuser panel 24 adjacent to poster 28. If poster 28 were to come into contact with both the adjacent surfaces of face panel 22 and diffuser panel 24, this condensation could accumulate causing water damage or marking of poster 28, which is undesirable. While the water damage is more likely to occur near the bottom of poster 28, capillary action would likely cause the water to move upwardly causing substantial marking or wrinkling of the poster.

The spacing of poster 28 from face panel 22 and diffuser panel 24, and the circulation of air around poster 28, as discussed above, substantially prevents moisture from condensing on panels 22, 24 adjacent to poster 28.

The concave shape of diffuser panel 24 maintains this spacing by preventing this panel from contacting poster 28. If temperature increases cause face panel 22 and diffuser panel 24 to expand and bulge, diffuser panel 24 will bulge further inwardly away from poster 28, so that it will not contact poster 28. Even if under extreme temperature change conditions, condensation should form on the surfaces of face panel 22 and diffuser panel 24, this condensation would just run downwardly and out through lower vent openings 32. If any condensation on face panel 22 should contact poster 28, the air flow past and around poster 28 described above removes this excess moisture before the poster is damaged. This moisture is not allowed to accumulate primarily because poster 28 is not sandwiched or contacted by both panels 22, 24, which in turn is a result of the concave shape of diffuser panel 24. In fact, because poster 28 is tucked behind rods 64 and retaining angle 68, only in extreme cases of expansion of face panel 22 would even this panel be likely to touch poster 28.

When poster 28 is installed in display sign 10, the moisture content of the poster will depend upon the relative humidity of the ambient air. If the relative humidity subsequently changes, the poster 28 may expand or contract slightly. However, the VELCRO fasteners 30 and the initial horizontal tension applied to poster 28 allow the poster to expand or contract horizontally to prevent the formation of wrinkles which may otherwise be formed due to humidity changes. The downward tension on poster 28 produced by rods 64 permits poster 28 to expand or contract vertically. Poster 28 therefore remains taut and resistant to the formation of undesirable wrinkles caused by atmospheric changes.

Having described a preferred embodiment of the invention, it will be appreciated that various modifications may be made to the structure described. For example, the VELCRO fasteners 30 may be replaced by any other fastening means comprising two cohesive fabrics that adhere when pressed together. One other type of such fastener has one mating fabric formed with a plurality of mushroom shaped projections and the other mating fabric formed with a plurality of loops that engage the projections when the pieces are pressed together.

Other types of fasteners could be used as well. For example eyelets could be placed in the corners of the poster and springs could be attached to the display sign to pass through and hook onto the eyelets. However, with this type of fastener it may be difficult to obtain even tension on the poster. In addition, spring or hook type fasteners usually require additional space between face panel 22 and diffuser panel 24, which results in undesirably wide display signs.

In place of vertical rods 64, a weight could be attached along the bottom edge of the poster. However, this could cause the bottom edge of the poster to curl up unless the weight was guided to prevent rotation. Rods 60 and the fasteners 30 attached thereto tend to keep poster 28 very flat or planar because of the downward and outward tension applied to the poster caused by the weight of rods 60 and the horizontal tension provided by the VELCRO fasteners.

Figure 1:
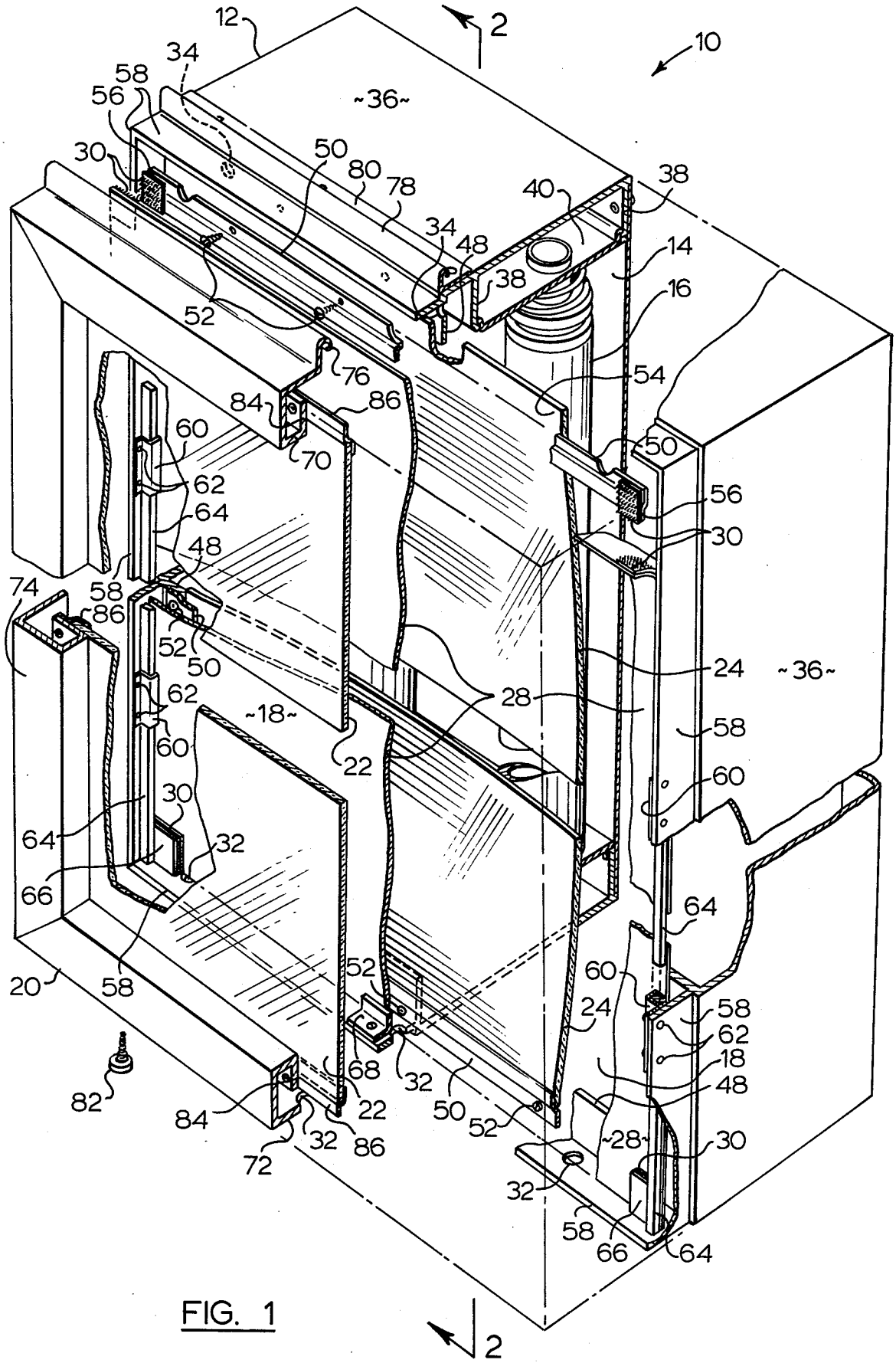
FIG. 1 is a perspective exploded view, partly broken away, of a display sign according to the present invention.

Rods 60 have been described as being rectangular in cross-section. However, a round cross-sectional rod could be used. A round rod would tend to rotate and would be less likely to keep poster 28 flat unless means are provided to prevent the round rod from rotating. A single guide bracket 60 also could be used to mount rod 60 rather than two guide brackets as shown in FIG. 1.

Diffuser panel 24 could be made concave in the direction of only one of its horizontal and vertical axes. However, this may cause uneven backlighting of the poster or it may produce unwanted shadows.

The display sign 10 described above has been described as having a single face panel so that the display sign contains one poster. However, additional face panels could be provided so that the display sign contains more than one poster. For example, two hinged closure panels 20 could be used, one being located on the rear of the display case facing in the opposite direction. Similarly, three display faces could be used in a triangular arrangement either by simply arranging three display signs 10 in a triangle or by modifying the enclosure for the light source so that a single light source is used to illuminate all three face panels. In this latter structure, one concave diffuser panel and one spaced transparent face panel would be provided for each poster.

What I claim as my invention is:

1. A display sign for displaying printed matter on a poster or the like comprising:

a display case defining a first compartment adapted to contain a light source, the display case having a front opening for the transmission of light therethrough and a closure panel adapted to cover said opening, the closure panel having a central transparent face panel;

a concave translucent diffuser panel located between said face panel and said light source, the curvature of said concave diffuser panel extending toward the light source to define a second compartment between the diffuser panel and a face panel; and releasable fastening means for locating said poster in the second compartment spaced between the face panel and the concave diffuser panel, so that the poster is viewed through the transparent face panel and may be backlighted by the light source.

2. A display sign as claimed in claim 1 wherein the display case further includes lower vent openings communicating with the second compartment and upper vent openings communicating with both the first and second compartments for the passage of air therebetween.

3. A display sign as claimed in claim 1 and further comprising vertical rods slideably mounted in the display case adjacent to the lower vertical side edges of the poster, and wherein said releasable fastening means includes fasteners located between the upper corners of the poster and adjacent portions of the display case and between the lower corners of the poster and the lower end portions of the rods, so that downward movement of the rods tends to hold the poster in vertical tension.

4. A display sign as claimed in claim 2 and further comprising vertical rods slideably mounted on the display case adjacent to the lower vertical side edges of the poster, and wherein said releasable fastening means includes fasteners located between the upper corners of the poster and adjacent portions of the display case and between the lower corners of the poster and lower end portions of the rods, so that downward movement of the rods tends to hold the poster in vertical tension.

5. A display sign as claimed in claim 1 wherein the concave translucent diffuser panel is concave in the direction of both the vertical and horizontal axes of said panel.

6. A display sign as claimed in claim 3 wherein the concave translucent diffuser panel is concave in the direction of both the vertical and horizontal axes of said panel.

7. A display sign as claimed in claim 3 wherein said fasteners are formed of two cohesive fabrics which adhere when pressed together, one of said fabrics being located on each of said upper corners of the poster and the other of said fabrics being located on said adjacent portion of the display case, and one of said fabrics being located on each of said lower corners of the poster and the other of said fabrics being located on said adjacent end portions of the rods.

8. A display sign as claimed in claim 4 wherein said fasteners are formed of two cohesive fabrics which adhere when pressed together, one of said fabrics being located on each of said upper corners of the poster and the other of said fabrics being located on said adjacent portion of the display case, and one of said fabrics being located on each of said lower corners of the poster and the other of said fabrics being located on said adjacent end portions of the rods.

9. A display sign as claimed in claim 7 wherein said fasteners at the upper corners of the poster are located adjacent to the rear surface of the poster, and wherein said fasteners at the lower corners of the poster are located adjacent to the front surface of the poster.

10. A display sign as claimed in claim 8 wherein said fastener at the upper corners of the poster are located adjacent to the rear surface of the poster, and wherein said fasteners at the lower corners of the poster are located adjacent to the front surface of the poster.

11. A display sign as claimed in claim 7 wherein said rods are rectangular in cross section.

12. A display sign as claimed in claim 7 wherein one of said cohesive fabrics is formed with a plurality of hooks and the other of said cohesive fabrics is formed with a plurality of loops, the fabric with the loops being located on the poster and the fabric with the hooks being located on the display case.

13. A display sign as claimed in claim 4 wherein said closure panel is hingeably mounted on the display case.

* * * * *